United States Patent [19]

Krutsch

[11] Patent Number: 4,865,322

[45] Date of Patent: Sep. 12, 1989

[54] GAME CABINET

[75] Inventor: John R. Krutsch, Glenview, Ill.

[73] Assignee: Williams Electronics Games, Inc., Chicago, Ill.

[21] Appl. No.: 236,259

[22] Filed: Aug. 25, 1988

[51] Int. Cl.[4] ..... A63D 3/02; A47B 88/00

[52] U.S. Cl. ..... 273/121 R; 312/201; 312/251; 312/325; 312/327

[58] Field of Search ..... 273/121 A, 119 A, 121 R, 273/148 B, 127, 129 T, 85 B; 312/325, 328, 327, 201, 251

[56] References Cited

U.S. PATENT DOCUMENTS

| | | | |
|---|---|---|---|
| 852,904 | 5/1907 | Reed | 273/121 A |
| 2,470,325 | 5/1949 | Stillman | 273/121 A |
| 3,675,927 | 7/1972 | Gottlieb et al. | 273/119 A |
| 4,397,509 | 8/1983 | Miller et al. | 273/148 B |
| 4,440,457 | 4/1984 | Fogelman et al. | 312/7.2 |
| 4,647,043 | 3/1987 | Wiczer | 273/121 R |

FOREIGN PATENT DOCUMENTS

| | | | |
|---|---|---|---|
| 2124505 | 2/1984 | United Kingdom | 273/121 A |

*Primary Examiner*—Edward M. Coven
*Assistant Examiner*—Gary Jackson
*Attorney, Agent, or Firm*—Rockey and Rifkin

[57] ABSTRACT

A game cabinet for pinball machines including a horizontal and vertical playfield comprises a horizontal case for the horizontal playfield and a vertical case for the vertical playfield. The two cases are pivotably interconnected so the vertical case can be positioned on top of, and parallel to, the horizontal case for transporting the pinball machine. The vertical case also has a pivotable marquee and a removable vertical playfield for service access.

10 Claims, 2 Drawing Sheets

GAME CABINET

BACKGROUND OF THE INVENTION

This invention relates to game cabinets for coin operated amusement games such as pinball machines.

A recent development in the art of coin operated amusement games is a pinball machine that has both horizontal and vertical playfields. Such a device is described in a pending U.S. patent application to Lawlor and Demar entitled "Pinball Machine," Ser. No. 063,126, filed June 17, 1987. This development has accentuated the need for an improved game cabinet that can house such a design yet be shipped safely and compactly with a minimum of dismantling and reassembly.

Pinball machines with only horizontal playfields have previously used removable "backboxes" to house the score displays. The increased complexity of a machine with both horizontal and vertical playfields, however has necessitated the design of a cabinet with easy access to the vertical playfield electronics and mechanical elements as well as a cabinet with easy shipping and setup characteristics.

SUMMARY OF THE INVENTION

The present invention is comprised of a vertical case pivotally mounted at its lower end to a horizontal case. Each case houses the respective playfields and associated electronic and electromechanical elements of the game. A marquee is pivotable about the upper end of the vertical case.

One feature of the present invention is a marquee cover that slides in and out of a slot, or guide means, to permit access to the face of the marquee. A rotating disk secures the cover in the slot so the cover does not slide out while the marquee is rotated up and out of the vertical case.

Another important feature of the invention is the design of the upper end of the vertical case. When the upper case is pivoted to a position parallel with the horizontal case, the upper end overlaps the sides of the horizontal case to stabilize the two cases. This parallel configuration of the two cases results in a compact, secure arrangement for shipping the game cabinet.

Another significant aspect of the game cabinet is the arrangement by which the bottom of the vertical playfield can be pivoted and removed from the vertical case. The top of the vertical playfield is secured by a metal tongue with two tabs at one end. A downwardly facing tab holds the top of the vertical playfield while an upwardly facing tab cooperates with a lock that secures the marquee. These and other advantages of the invention are disclosed in the drawings and remaining portions of this specification.

DETAILED DESCRIPTION OF THE PREFERRED EMBODIMENTS

Figure 1:
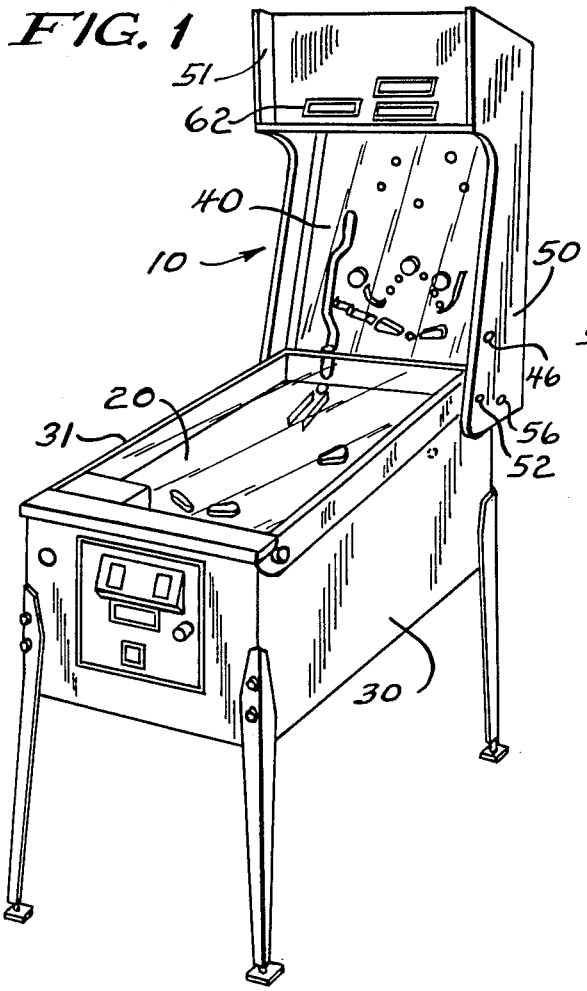
FIG. 1 is a perspective view of a pinball machine having horizontal and vertical playfields.
Figure 9:
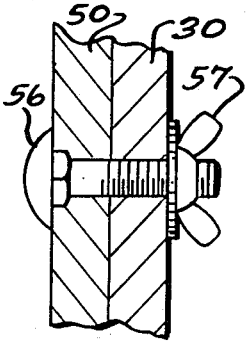
FIG. 9 is a vertical section of the bolt and wing nut that prevent the vertical case from pivoting.

A pinball machine, generally designated as 10, has a horizontal playfield 20 contained in horizontal case 30 and a vertical playfield 40 contained in vertical case 50. The vertical case pivots about two shoulder bolts 52 on each side of the case 50. Each bolt passes through a sleeve 54, which extends through holes 59 in both the horizontal case 30 and the vertical case 50. To secure the vertical case 50 when pivoting is undesired, a second bolt 56 (FIGS. 1 and 9) with wing nut 57 is fastened through aligned holes 58 that extend through both the vertical and horizontal cases 50 and 30. Thus, when it is desired to place the game cabinet 10 in a collapsed or compact configuration for shipping, bolts 56 are removed and the vertical case 50 is pivoted into the position shown in FIG. 2. A flexible conduit 32 protects the wires that connect the power and logic circuits running between the horizontal and vertical cases 30 and 50.

Figure 5:
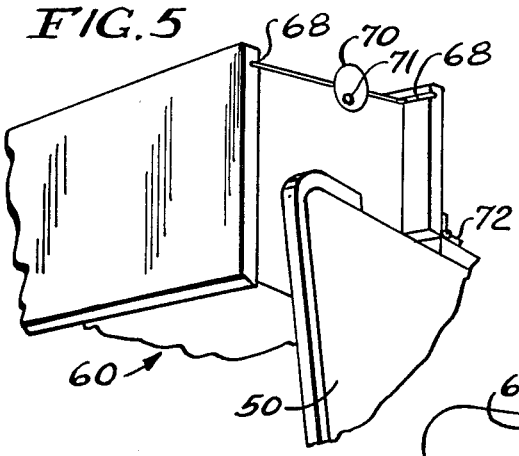
FIG. 5 is a perspective view of the marquee cover.
Figure 4:
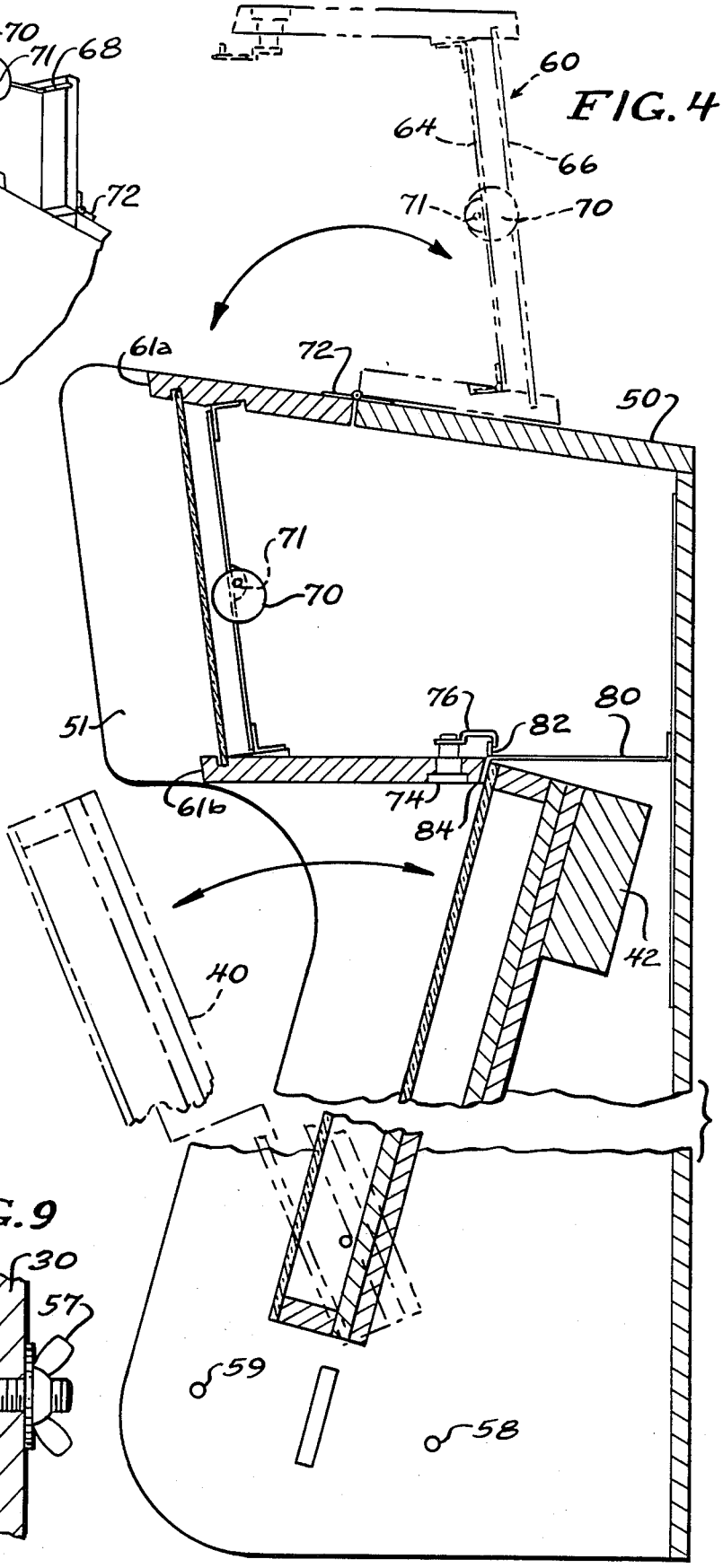
FIG. 4 is a side sectional view of the vertical case showing the pivoted and unpivoted positions of both the vertical playfield and the marquee.
Figure 6:
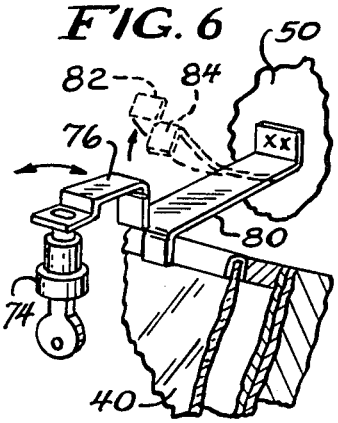
FIG. 6 is a perspective view depicting the metal tongue that secures the vertical playfield and cooperates with the marquee lock.

A marquee 60 is built into the upper portion of vertical case 50 and may contain scoring displays 62, game artwork, or other features. FIG. 4 shows how the marquee is hingedly connected to the vertical case 50 to facilitate access to the components inside the marquee 60 and the vertical case 50. The front 64 of the marquee is protected by a clear glass or plastic cover 66. The cover 66 slides in guide means or slots 68 (FIG. 5) to provide access to the front 64 of the marquee. A thin, rotatable metal disk 70 secures the cover 66 in the slots 68. This prevents the cover 66 from inadvertent movement while the marquee 60 is raised, thus eliminating the risk of breakage when the marquee is lowered to its locked position (FIG. 4). The disk 70 pivots about a pin or flat head nail 71.

A hinge 72 pivotably connects the top of the marquee 60 to the top of vertical case 50 to permit access to the interior of the marquee and the vertical case. A cylinder lock 74 with a rotating clasp 76 locks to upward tab 82 of a metal tongue 80, which is fastened to the back of vertical case 50. The marquee itself is slightly recessed into the upper portion of vertical case 50, thus creating ears 51.

Figure 2:
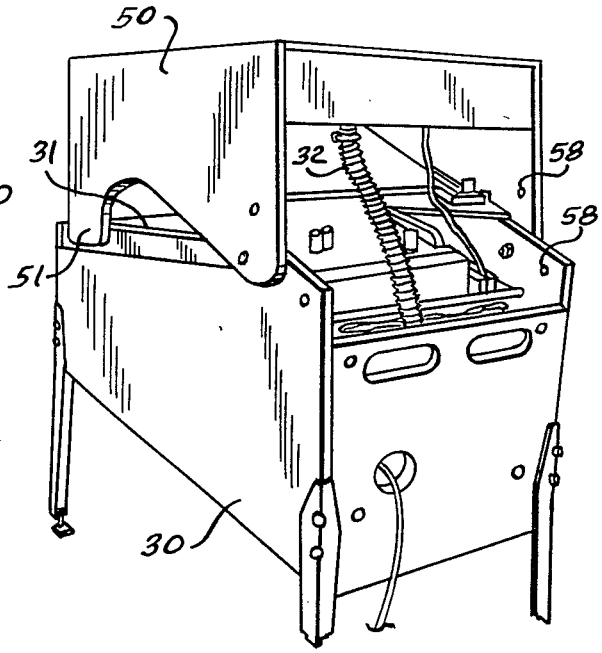
FIG. 2 is a rear perspective view of the pinball machine with the vertical case pivoted to a collapsed, horizontal position.

When the case 50 is collapsed into the compact configuration of FIG. 2, the ears 51 of the case 50 fit over the outside of horizontal case 30. Thus, the horizontal and vertical cases 30 and 50 are restrained from relative sideways or torsional movement. The top edge 61a and bottom edge 61b of marquee 60 extend beyond slot 68. Consequently, when the edges of the marquee 60 rest on the edges 31 of the horizontal case, the cover 66 is protected from breaking. It is, of course, contemplated that the preceding configuration of the horizontal case, vertical case, and marquee can be used in a pinball machine with only a horizontal playfield. Thus, the vertical case would contain scoring displays and not a vertical playfield, or the scoring displays could be placed in whole or in part in the marquee.

Figure 3:
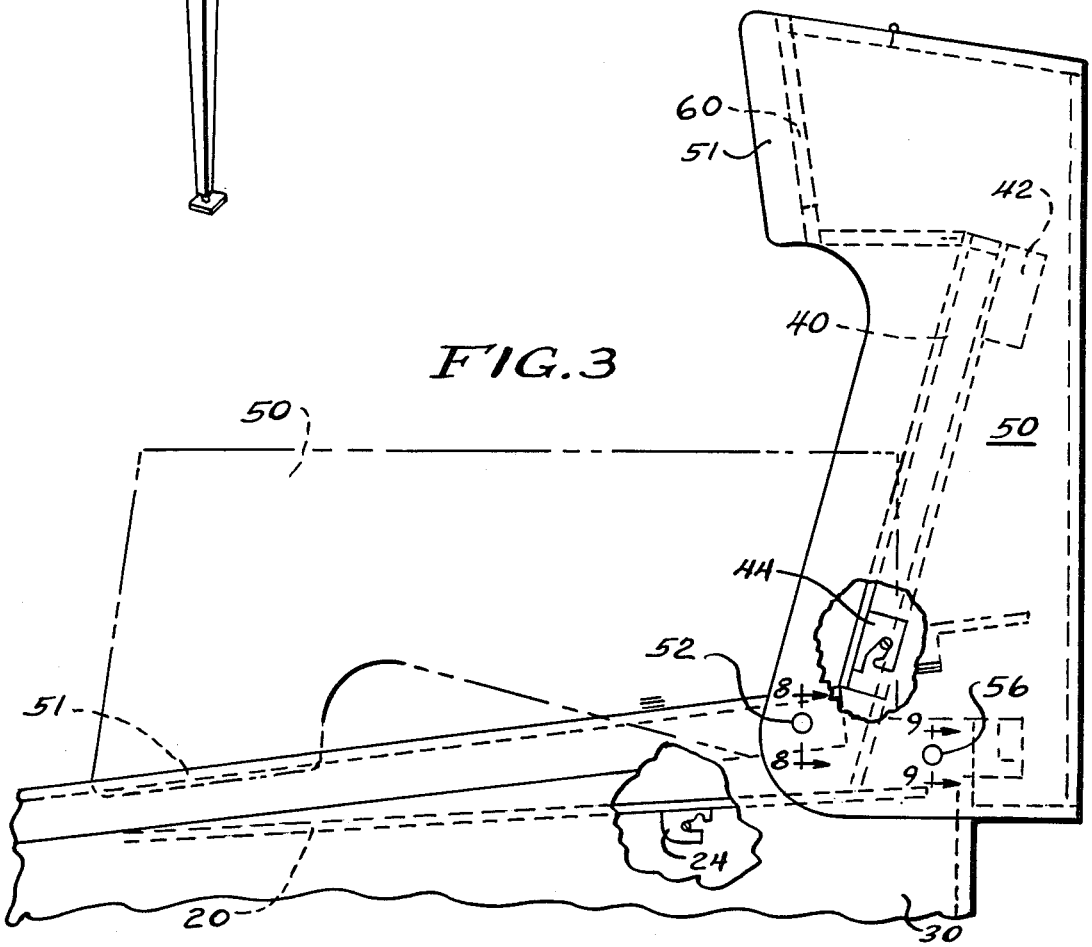
FIG. 3 is a side elevation view depicting the vertical case in both its vertical and horizontal positions.
Figure 7:
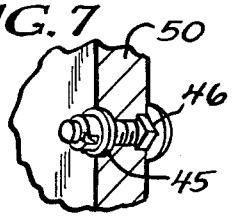
FIG. 7 is a perspective view of the pivot bolt for the vertical playfield.
Figure 8:
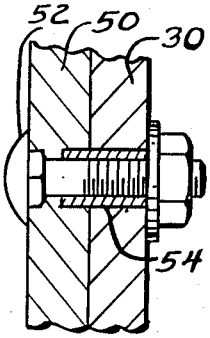
FIG. 8 is a vertical section of the bolt and sleeve pivotably connecting the horizontal and vertical cases.

Vertical playfield 40 is secured in the vertical case 50 by downwardly facing tab 84, stop blocks 42, and pivot plates 44. When the marquee 60 is unlocked and pivoted upwardly, playfield 40 can be pivoted to the left as depicted in FIG. 4. Pivot plates 44 (FIG. 3) each have a slot with a rounded end that fit over a round pivot nut 45 secured to the end of bolt 46 extending through vertical case 50 (FIG. 7). The open end of the slots in pivot plates 44 permit the removal of the vertical playfield 40 from the vertical case. This is accomplished by lifting the vertical playfield 40 until the slots in plates 44 clear nuts 45.

Preferably the horizontal playfield 20 is conventionally attached to horizontal case 30 by two pivot plates 24 (FIG. 3) similar to plates 44. Fast, easy access is thus available to any portion of the game cabinet 10.

Various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims:

What is claimed is:

1. A game cabinet for a coin operated amusement game comprising:

a horizontal case for housing a first game playfield including means for permitting access to said playfield;

a vertical case for housing a scoring display, said vertical case being pivoted at its lower end to said horizontal case; and said vertical case having an upper portion which projects forwardly therefrom to abut and overlap said horizontal case to protect a restrain relative sideways movement of said cases during transit when said vertical case is pivoted to a position parallel to said horizontal case.

2. The apparatus of claim 1 further including a marquee which is pivotable about the upper end of said vertical case to permit access to said scoring display.

3. A game cabinet for a coin operated amusement game, comprising:

a horizontal case for housing a first game playfield including means for permitting access to said playfield;

a vertical case for housing a second game playfield, said vertical case being pivoted at its lower end to said horizontal case, said vertical case being dimensioned to abut and overlap said horizontal case to protect said cases during transit when the vertical case is pivoted to a position parallel to said horizontal case; and a marquee pivotable about the upper end of said vertical case to permit access to said second game playfield.

4. The game cabinet of claim 3 wherein said marquee includes a marquee cover slidably positioned in guide means for facilitating the installation and removal of said marquee cover.

5. The game cabinet of claim 4 further comprising a means for securing said marquee cover in said guide means.

6. The game cabinet of claim 3 further comprising means to lockably attach said marquee to said vertical case.

7. The game cabinet of claim 6 wherein the vertical playfield has one end pivotably attached to said vertical case to provide access behind the second game playfield.

8. The game cabinet of claim 6 further comprising means for holding one end of the second game playfield within said vertical case.

9. The game cabinet of claim 8 wherein said holding means also cooperates to lockably attach said marquee.

10. The game cabinet of claim 6 further comprising means for securing said vertical case against pivoting.

* * * * *